US007210234B2

(12) United States Patent
Chen

(10) Patent No.: US 7,210,234 B2
(45) Date of Patent: May 1, 2007

(54) BOW SAW STRUCTURE

(76) Inventor: Teng Lung Chen, No. 440-1, Cheng-Fon Lane, Tai-Min Rd., Wu-Jih, 414 Taichung (TW)

( * ) Notice: Subject to any disclaimer, the term of this patent is extended or adjusted under 35 U.S.C. 154(b) by 0 days.

(21) Appl. No.: 11/197,514

(22) Filed: Aug. 5, 2005

(65) Prior Publication Data

US 2007/0028465 A1 Feb. 8, 2007

(51) Int. Cl.
*B27B 21/06* (2006.01)

(52) U.S. Cl. ..... 30/513; 30/517

(58) Field of Classification Search ..... 30/506, 30/507, 508, 510, 513, 514, 517, 511
See application file for complete search history.

(56) References Cited

U.S. PATENT DOCUMENTS 2,559,686 A * 7/1951 Suhre et al. ..... 30/510
2,691,396 A * 10/1954 Harrison ..... 30/513
2,725,085 A * 11/1955 Doherty et al. ..... 30/506
2,880,773 A * 4/1959 Contreras et al. ..... 30/510
2,941,558 A * 6/1960 Dreier ..... 30/510
2,944,571 A * 7/1960 Johnson ..... 30/506
3,173,461 A * 3/1965 Johnson ..... 30/510
3,672,418 A * 6/1972 Dreier ..... 30/506
5,271,158 A * 12/1993 Chen ..... 30/508
5,388,333 A * 2/1995 Chen ..... 30/508
6,070,330 A * 6/2000 Phelon et al. ..... 30/513
6,457,244 B1 * 10/2002 Huang ..... 30/513
6,772,522 B1 * 8/2004 Huang et al. ..... 30/513

* cited by examiner

*Primary Examiner*—Hwei-Siu Payer

(57) ABSTRACT

A bow saw structure including a handle, an adjustment unit and a fast installation/detachment unit. The handle has a grip section for a user's hand to extend through and hold. An upper side of the grip section is formed with a tunnel in which an L-shaped support member can be inserted. A first tightening member is disposed in the tunnel. The adjustment unit is mounted on upper side of the grip section for controlling the depth of the tunnel, whereby different lengths of saw blades are installable on the bow saw. The fast installation/detachment unit is pivotally disposed on lower side of the handle. A second tightening member is arranged in the fast installation/detachment unit. The second tightening member and the handle are arranged on the same side of the bow saw. One end of the tightening member protrudes from the handle.

8 Claims, 7 Drawing Sheets

BOW SAW STRUCTURE

BACKGROUND OF THE INVENTION

The present invention is related to a bow saw structure including an adjustment unit for controlling the depth of a tunnel of the handle. By means of adjusting the depth of the tunnel, different lengths of saw blades can be replaced with each other. A fast installation/detachment unit and the handle are arranged on the same side of the bow saw. By means of the fast installation/detachment unit, a user can quickly and conveniently replace the saw blade.

FIG. 8 shows a conventional bow saw 7 integrally having a handle 8 for a user to hold. A butterfly nut 81 is disposed on one side of the bow saw 7 opposite to the handle 8. When mounting a saw blade 82 on the bow saw 7, the butterfly nut 81 can be tightened to fix the saw blade 82 with the handle 8. When detaching the saw blade 82, the butterfly nut 81 must be unscrewed for taking off the saw blade 82.

It is necessary to screw or unscrew the butterfly nut 81 for installing or detaching the saw blade 82. Therefore, it is time-consuming to replace the saw blade 82.

Moreover, when installing the saw blade 82, a user needs to hold the saw blade 82 with one hand and screw the butterfly nut 81 with the other hand. This is quite inconvenient to the user.

Also, the bow saw 7 is integrally formed so that only the saw blade with the same length can be mounted on the bow saw 7. A longer or shorter saw blade is not applicable to the bow saw 7.

SUMMARY OF THE INVENTION

It is therefore a primary object of the present invention to provide an improved bow saw structure including a fast installation/detachment unit pivotally disposed on lower side of the handle. By means of the fast installation/detachment unit, a user can quickly and conveniently fix or loosen the saw blade. The bow saw further includes an adjustment unit by which different lengths of saw blades are installable on the bow saw.

According to the above object, the bow saw structure of the present invention includes a handle, an adjustment unit and a fast installation/detachment unit.

The handle has a grip section for a user's hand to extend through and hold. An upper side of the grip section is formed with a tunnel in which a first tightening member is disposed.

The adjustment unit is mounted on the upper side of the grip section for controlling the depth of the tunnel. Two sides of the adjustment unit are respectively formed with two projecting sections.

The fast installation/detachment unit is pivotally disposed on lower side of the handle. A tightening member is arranged in the fast installation/detachment unit. One end of the tightening member protrudes from the handle.

The present invention can be best understood through the following description and accompanying drawings wherein:

DETAILED DESCRIPTION OF THE PREFERRED EMBODIMENTS

Figure 1:
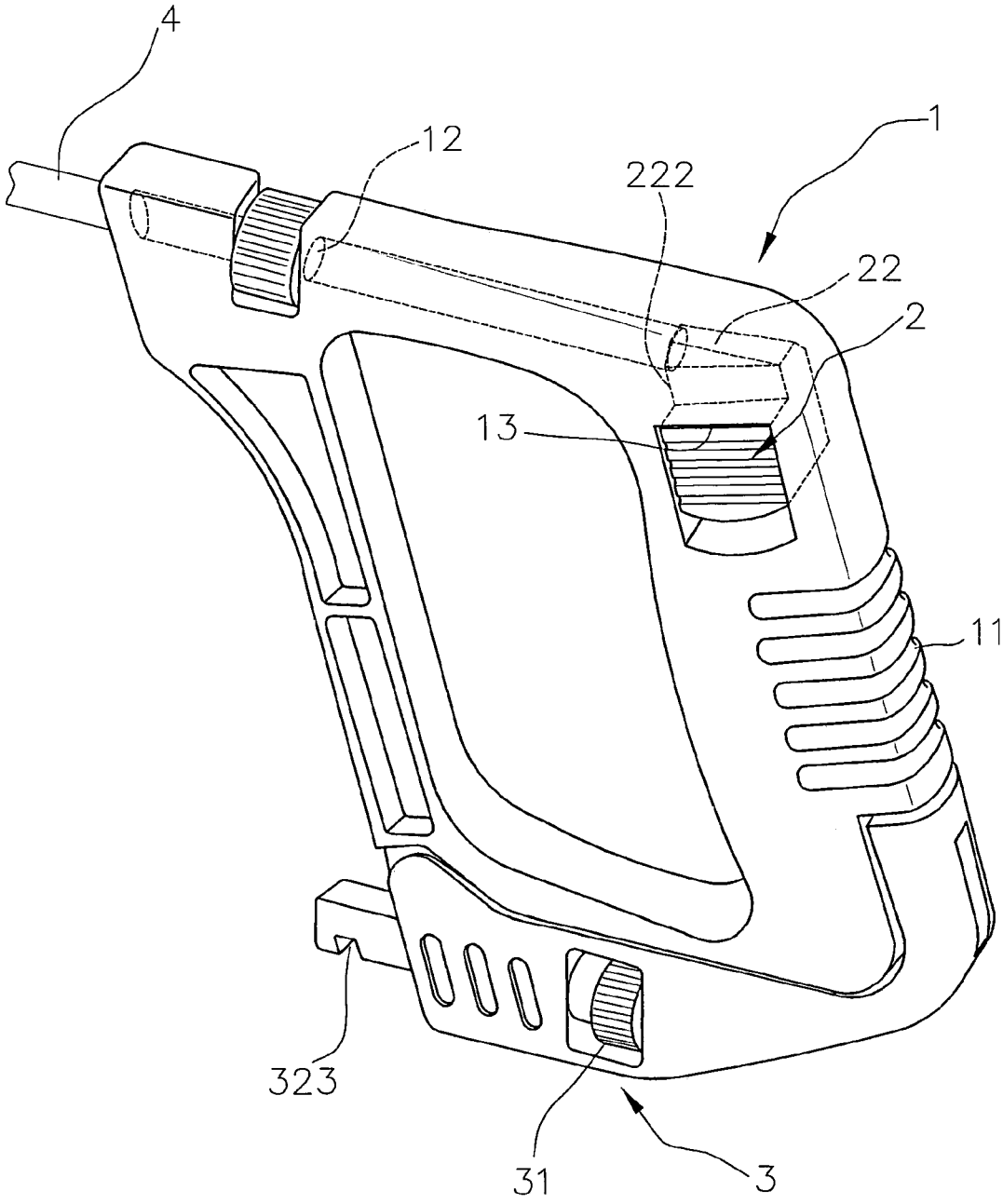
FIG. 1 is a perspective assembled view of a first embodiment of the present invention.
Figure 2:
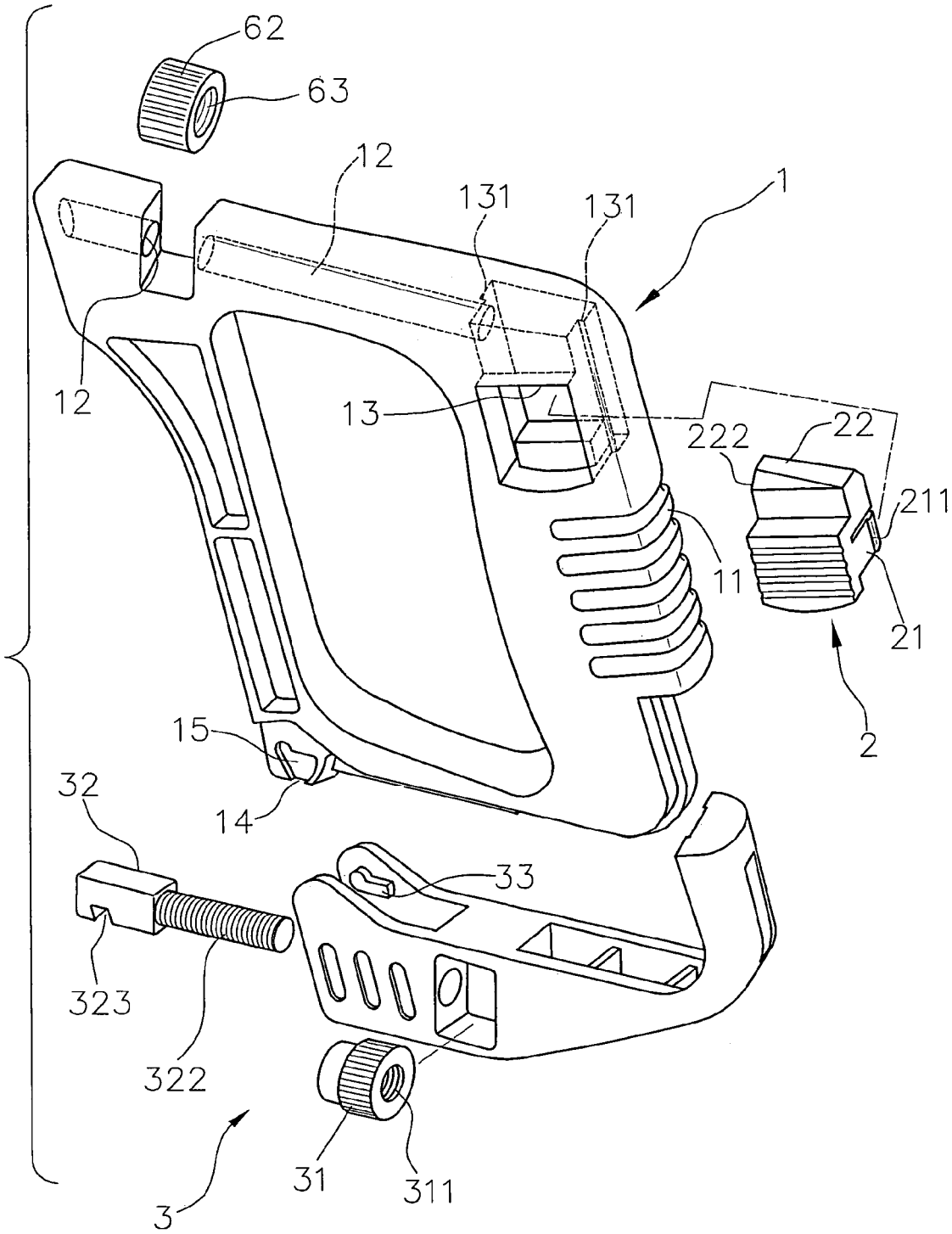
FIG. 2 is a perspective exploded view of the first embodiment of the present invention.
Figure 3:
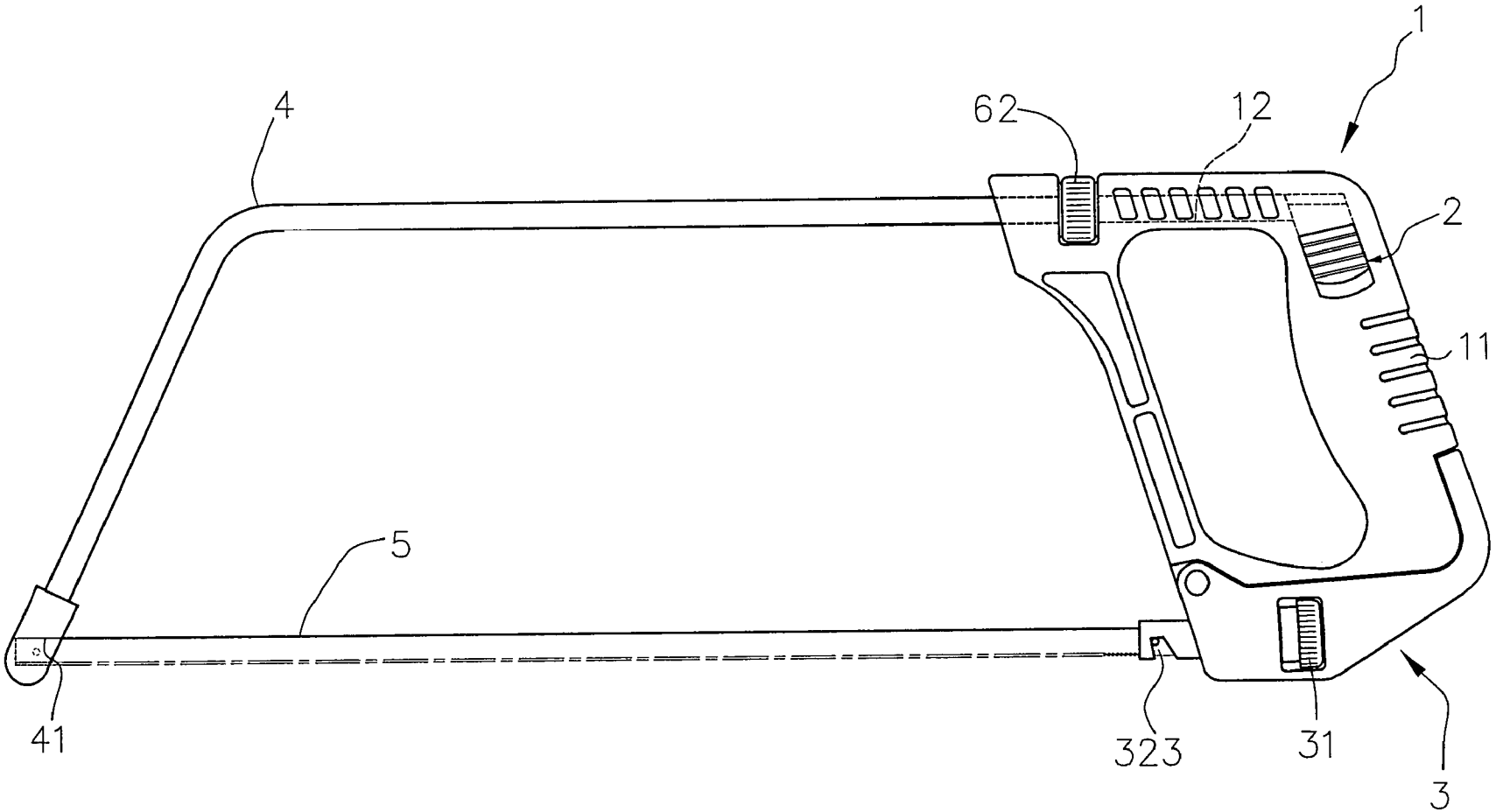
FIG. 3 is a side view of the first embodiment of the entire bow saw of the present invention.
Figure 4:
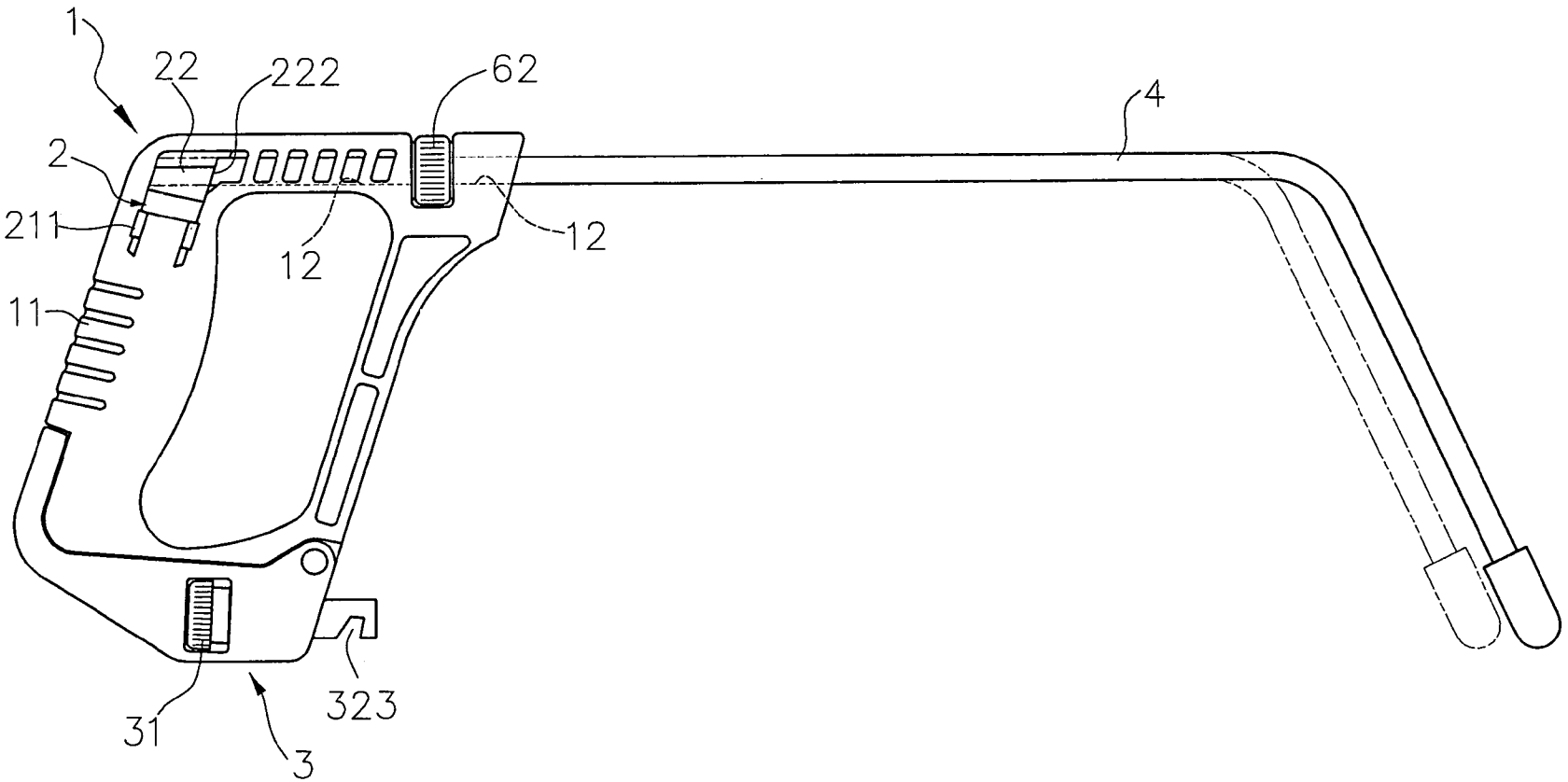
FIG. 4 is a side view of the first embodiment of the present invention, showing that the support member is adjusted by means of the adjustment unit.
Figure 5:
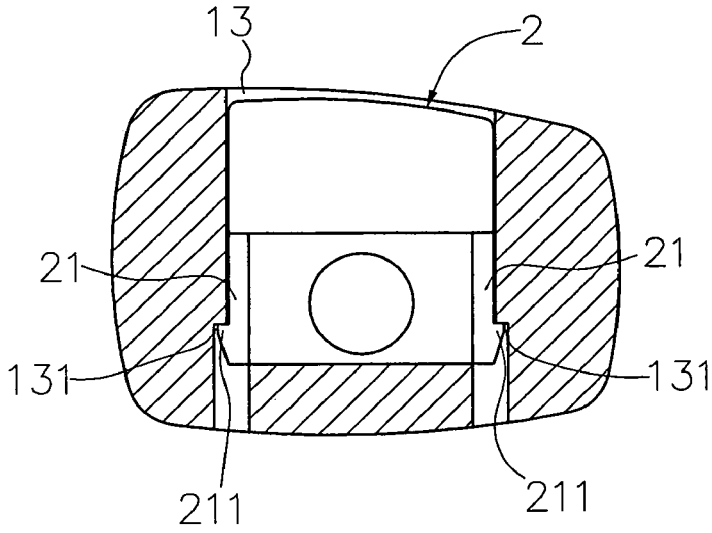
FIG. 5 is a sectional view of the first embodiment of the present invention, showing that the adjustment unit is mounted in a window of the handle.
Figure 6:
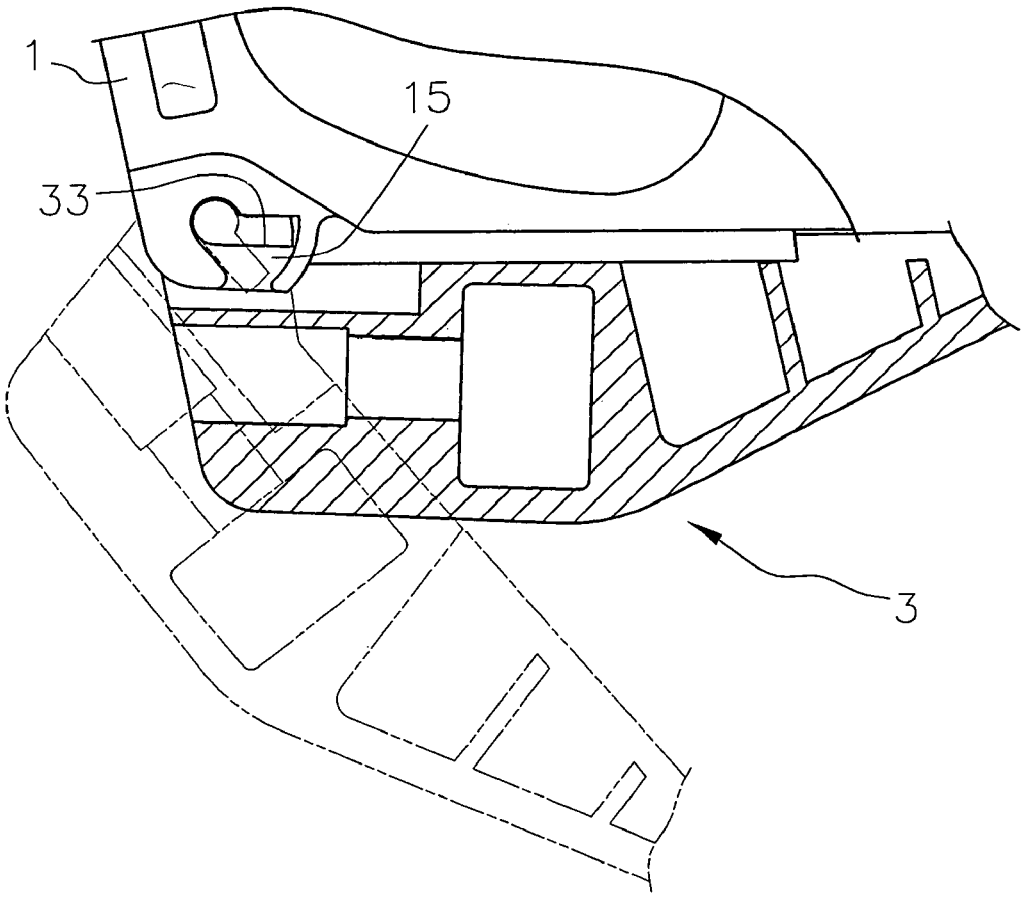
FIG. 6 is a sectional view of the first embodiment of the present invention, showing that the fast installation/detachment unit is pivotally connected with the handle.

Please refer to FIGS. 1 to 7. The bow saw structure of the present invention includes a handle 1, an adjustment unit 2 and a fast installation/detachment unit 3.

The handle 1 has a grip section 11 for a user's hand to extend through and hold. An upper side of the grip section 11 is formed with a tunnel 12 for one end of an L-shaped support member 4 to insert therein. The other end of the L-shaped support member 4 is formed with a split 41 in which a saw blade 5 can be located The adjustment unit 2 is mounted on upper side of the grip section 11 for controlling the depth of the tunnel 12. The adjustment unit 2 has a triangular protrusion 22 extending from a top thereof and the triangular protrusion 22 has an end 222 contacting against the L-shaped support member 4. When the adjustment unit 2 moves upward into the tunnel 12, the triangular protrusion 22 contacts the L-shape member, so that the depth of the tunnel 12 is shallow. When the adjustment unit 2 moves downward to retract from the tunnel 12, the depth of the tunnel 12 is deep. By means of adjusting the depth of the tunnel 12, the L-shaped support member 4 can be inserted into the tunnel 12 by different depth. Accordingly, the length of the L-shaped support member 4 can be adjusted. Accordingly, different length of saw blades 5 can be replaced with each other.

The upper side of the handle 1 is formed with a window 13 in which the adjustment unit 2 is placed.

Two sides of the adjustment unit 2 are respectively formed with sections 21. The projecting section 21 has one slope 211. The window 13 includes two L-shaped recesses 131 therein and when the adjustment unit 2 is located in the window 13. The projecting section 21 retracts inward and the slopes 211 are engaged with the recesses 131. By means of the slopes 211, the adjustment unit 2 can be obliquely installed into the window 13 of the handle 1. In addition, the projecting section 21 prevents the adjustment unit 2 from dropping out of the window 13.

The fast installation/detachment unit 3 is pivotally disposed on lower side of the handle 1. A second tightening member 31 is arranged in the fast installation/detachment unit 3. In this embodiment, the second tightening member 31 is composed of a connection piece 32 having a threaded end 322 and a knob 31 having a threaded inner periphery 311. The connection piece 32 and the knob 31 are tightly connected to each other. One end of the connection piece 32 protrudes from the handle 1 and is formed with a notch 323 in which the saw blade 5 is located.

The lower side of the handle 1 is formed with two depressions 14 each having an opening 15. The fast installation/detachment unit 3 has two bosses 33 which can be located in the depressions 14 to pivotally connect the handle 1 with the fast installation/detachment unit 3.

When installing the saw blade 5, the saw blade 5 is first placed into the split 41 of the support member 4 and the notch 323 of the connection piece 32. Then the knob 311 is tightened to fix the saw blade 5. The second tightening member 31 and the handle 1 are on the same side of the bow saw. Therefore, when installed, a user needn't hold the saw blade 5 with one hand. This facilitates the installation of the saw blade 5.

Figure 7:
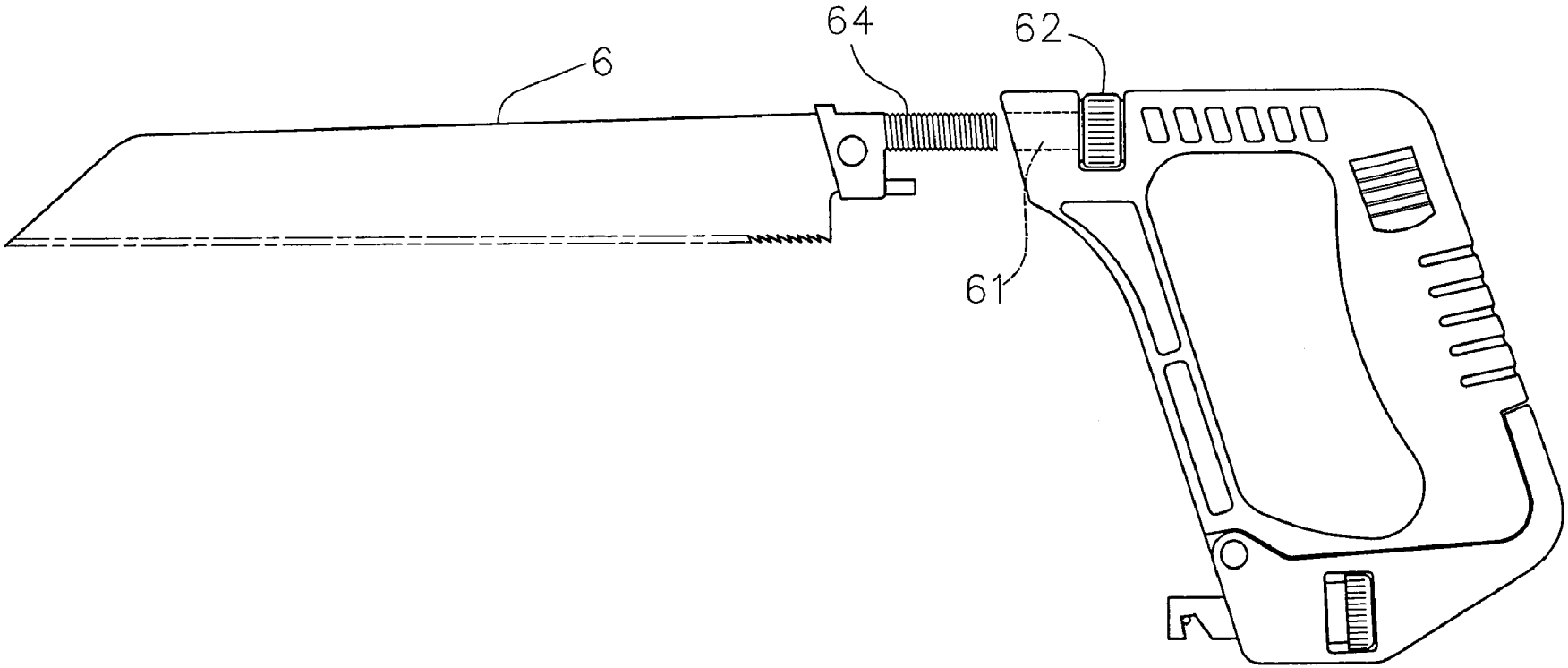
FIG. 7 is a side view of a second embodiment of the bow saw of the present invention.
Figure 8:
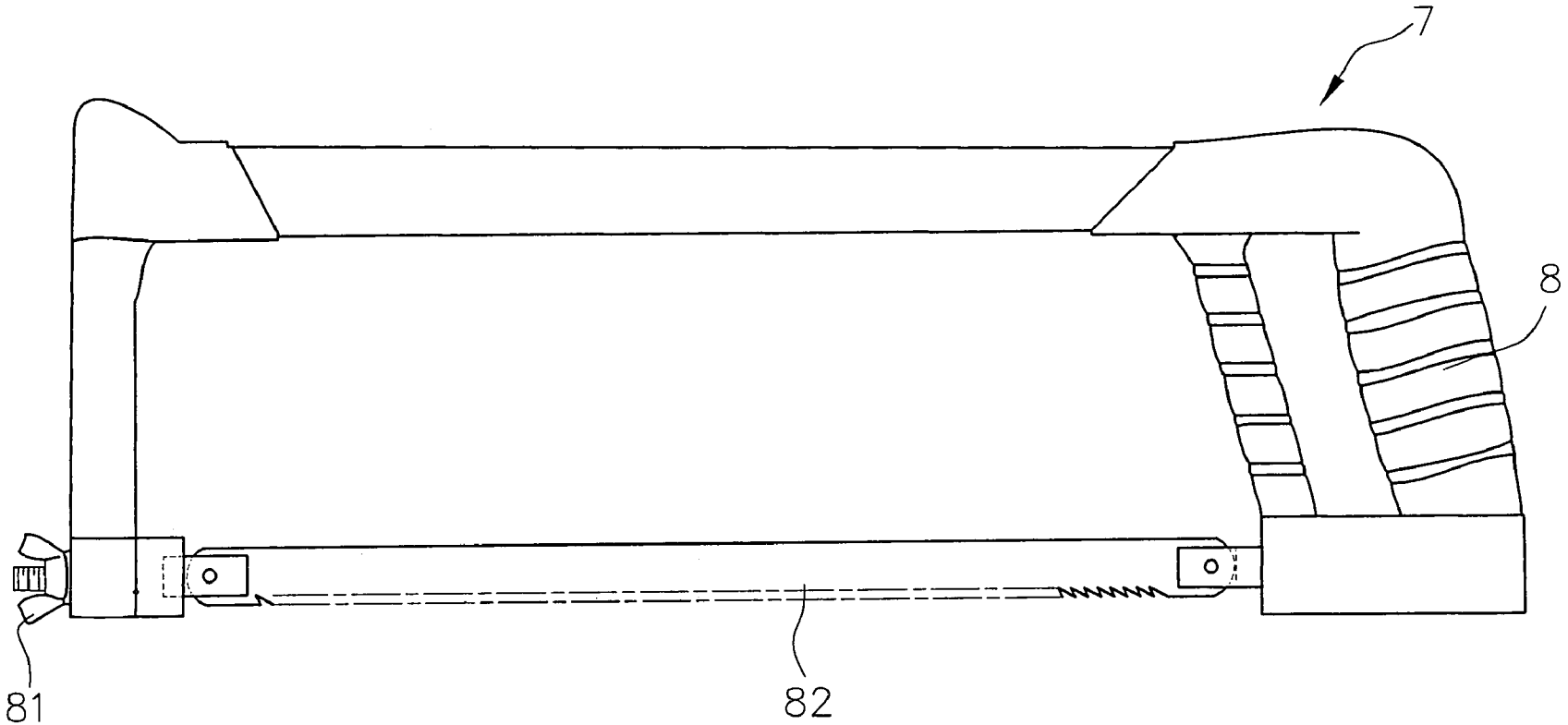
FIG. 8 PRIOR ART
FIG. 8 is a side view of a conventional bow saw.

FIG. 7 shows a second embodiment of the present invention, which is substantially identical to the first embodiment. The second embodiment is different from the first embodiment in that the support member 4 of the first embodiment is replaceable with a saw blade 6. The first tightening member 62 has a threaded inner periphery 63. The saw blade 6 has a threaded projection 64, after the saw blade 6 is inserted into the tunnel 61. The threaded inner periphery 63 is connected to the threaded projection 64, and tightening member 62 securelyconnects the threaded projection 64 to the tunnel 61. The saw blade 6 can be easily and quickly replaced. The present invention can be another type of saw simply by replacing the L-shaped support member 4 with the saw blade 6.

The above embodiments are only used to illustrate the present invention, not intended to limit the scope thereof. Many modifications of the above embodiments can be made without departing from the spirit of the present invention.

What is claimed is:

1. A bow saw structure comprising a handle, an adjustment unit and a fast installation/detachment unit, wherein:

the handle has a grip section for a user's hand to extend through and hold, an upper side of the grip section is formed with a tunnel in which a first tightening member is disposed;

the adjustment unit is mounted on the upper side of the grip section for controlling the depth of the tunnel, two sides of the adjustment unit being respectively formed with two projecting sections; and the fast installation/detachment unit is pivotally disposed on a lower side of the handle, a second tightening member being arranged in the fast installation/detachment unit, one end of the second tightening member protruding from the handle.

2. The bow saw structure as claimed in claim 1, wherein the upper side of the handle is formed with a window in which the adjustment unit is placed.

3. The bow saw structure as claimed in claim 2, wherein each of the projecting sections includes one slope so as to prevent the adjustment unit from dropping out of the window.

4. The bow saw structure as claimed in claim 1, wherein the lower side of the handle is formed with two depressions and the fast installation/detachment unit has two bosses which can be located in the depressions to pivotally connect the handle with the fast installation/detachment unit.

5. The bow saw structure as claimed in claim 4, wherein each depression of the handle has an opening, whereby the boss of the fast installation/detachment unit can be placed into the depression to pivotally connect the handle with the fast installation/detachment unit.

6. The bow saw structure as claimed in claim 1, wherein a support member or a saw blade can be inserted into the tunnel of the handle.

7. The bow saw structure as claimed in claim 6, wherein the support member is an L-shaped support member, one end of the L-shaped support member being inserted into the tunnel, while the other end of the L-shaped support member is formed with a split in which a saw blade can be located.

8. The bow saw structure as claimed in claim 1, the second tightening member is composed of a connection piece having a threaded end and a knob having a threaded inner periphery, the connection piece protruding from the handle is formed with a notch in which a saw blade can be located.

* * * * *